US005823298A

United States Patent [19]

Aulanko et al.

[11] Patent Number: 5,823,298

[45] Date of Patent: Oct. 20, 1998

[54] TRACTION SHEAVE ELEVATOR

[75] Inventors: Esko Aulanko, Kerava; Harri Hakala; Jorma Mustalahti, both of Hyvinkää, all of Finland

[73] Assignee: Kone Oy, Helsinki, Finland

[21] Appl. No.: 666,836

[22] Filed: Jun. 19, 1996

[30] Foreign Application Priority Data

Jun. 22, 1995 [FI] Finland ..... 953154

[51] Int. Cl.[6] ..... B66B 11/08

[52] U.S. Cl. ..... 187/266; 187/404

[58] Field of Search ..... 187/266, 250, 187/251, 252, 260, 256, 404

[56] References Cited

U.S. PATENT DOCUMENTS

| | | | |
|---|---|---|---|
| 4,739,969 | 4/1988 | Eckersley et al. | 254/378 |
| 5,018,603 | 5/1991 | Ito | 187/17 |

FOREIGN PATENT DOCUMENTS

| | | | |
|---|---|---|---|
| 0415218 A1 | 8/1990 | European Pat. Off. . | |
| 0631968A | 1/1995 | European Pat. Off. . | |
| 942062 | 5/1995 | Finland . | |
| 1451792 | 7/1966 | France . | |
| 1251926 | 10/1967 | Germany . | |
| 003922798 C1 | 9/1990 | Germany | 187/266 |
| 3922798 C1 | 9/1990 | Germany . | |
| 818694 | 7/1923 | Japan . | |
| 450297 | 8/1963 | Japan . | |
| 128937 | 8/1981 | Japan . | |
| 05078066A | 3/1993 | Japan . | |

*Primary Examiner*—Kenneth Noland
*Attorney, Agent, or Firm*—Birch, Stewart, Kolasch & Birch, LLP

[57] ABSTRACT

Traction sheave elevator in which the drive machinery together with the traction sheave is placed in an elevator shaft provided with guide rails for the elevator care and the counterweight. The hoisting ropes go upward from the traction sheave. The elevator comprises two diverting pulleys mounted on an upper part of one of the guide rails, the first one of the diverting pulleys carrying a hoisting rope portion going from the traction sheave to the elevator car while the second one carries a hoisting rope portion going from the traction sheave to the counterweight.

13 Claims, 4 Drawing Sheets

TRACTION SHEAVE ELEVATOR

FIELD OF THE INVENTION

The present invention relates to a traction sheave elevator in which the drive machinery with the traction sheave is placed in an elevator shaft.

DESCRIPTION OF THE BACKGROUND ART

One of the objectives in the development of elevators has been an efficient and economic utilization of building space. In conventional traction sheave driven elevators, the machine room or other space designed for housing the drive machinery of the elevator takes up a considerable portion of the building space needed for the elevator. The problem is not only the amount of space required by the drive machinery, but also its placement. There are many different solutions for placing the machine room, but generally they involve a significant restriction in the design of the building, at least in respect of space utilization or appearance. For example, a side drive elevator with machine room below requires a machine room or machine space placed beside the shaft, generally on the lowest floor of the building. Being a special space, the machine room generally increases the building costs.

In recent times, an elevator solution based on a flat machinery with a disc-type motor allowing the machine room to be omitted has been presented. An elevator with machinery below and employing a disc-type motor is presented in EP application publication 0 631 968 A2, in which the path of the counterweight lies above the machinery. Therefore, the minimum shaft height will be the sum of the height of the machinery and the length of the counterweight path plus the required safety distances.

SUMMARY OF THE INVENTION

To meet the need to further develop the traction sheave elevator with machinery below with no machine room and to achieve a reliable elevator which is advantageous in respect of economy and space utilization and in which, regardless of the hoisting height, the building space required for the elevator is substantially limited to the elevator shaft only, a new type of traction sheave elevator is presented as an invention. The traction sheave elevator of the invention is characterized by an elevator shaft, the elevator shaft having guide rails and the traction sheave elevator comprising a drive machinery with a traction sheave, the drive machinery and the traction sheave being in the elevator shaft, and elevator car and a counterweight mounted on the guide rails, hoisting ropes extending from the traction sheave, and at least two diverting pulleys mounted on one of the guide rails, a first one of the diverting pulleys carrying a hoisting rope portion going from the traction sheave to the elevator car and a second one of the diverting pulleys carrying a hoisting rope portion going from the traction sheave to the counterweight.

The invention provides various advantages, including the following:

- The location in the shaft for placing the machinery can largely be freely selected.
- The invention allows an optimal shaft height to be achieved.
- The traction sheave elevator of the invention allows a significant saving in building space to be achieved as no separate machine room is needed.
- The invention allows effective utilization of the cross-sectional area of the shaft.

- An advantageous overall solution allowing the weight of the elevator car and counterweight to be completely or at least partially supported by the guide rails.
- In elevators applying the invention, it is not difficult to achieve a centric suspension of the elevator car and counterweight and therefore a substantial reduction of the supporting forces applied to the guide rails.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention is described by the aid of an application example by referring to the attached drawings which are given by way of illustration only, and thus are not limitative of the present invention, and in which.

DESCRIPTION OF THE PREFERRED EMBODIMENTS

Figure 1:
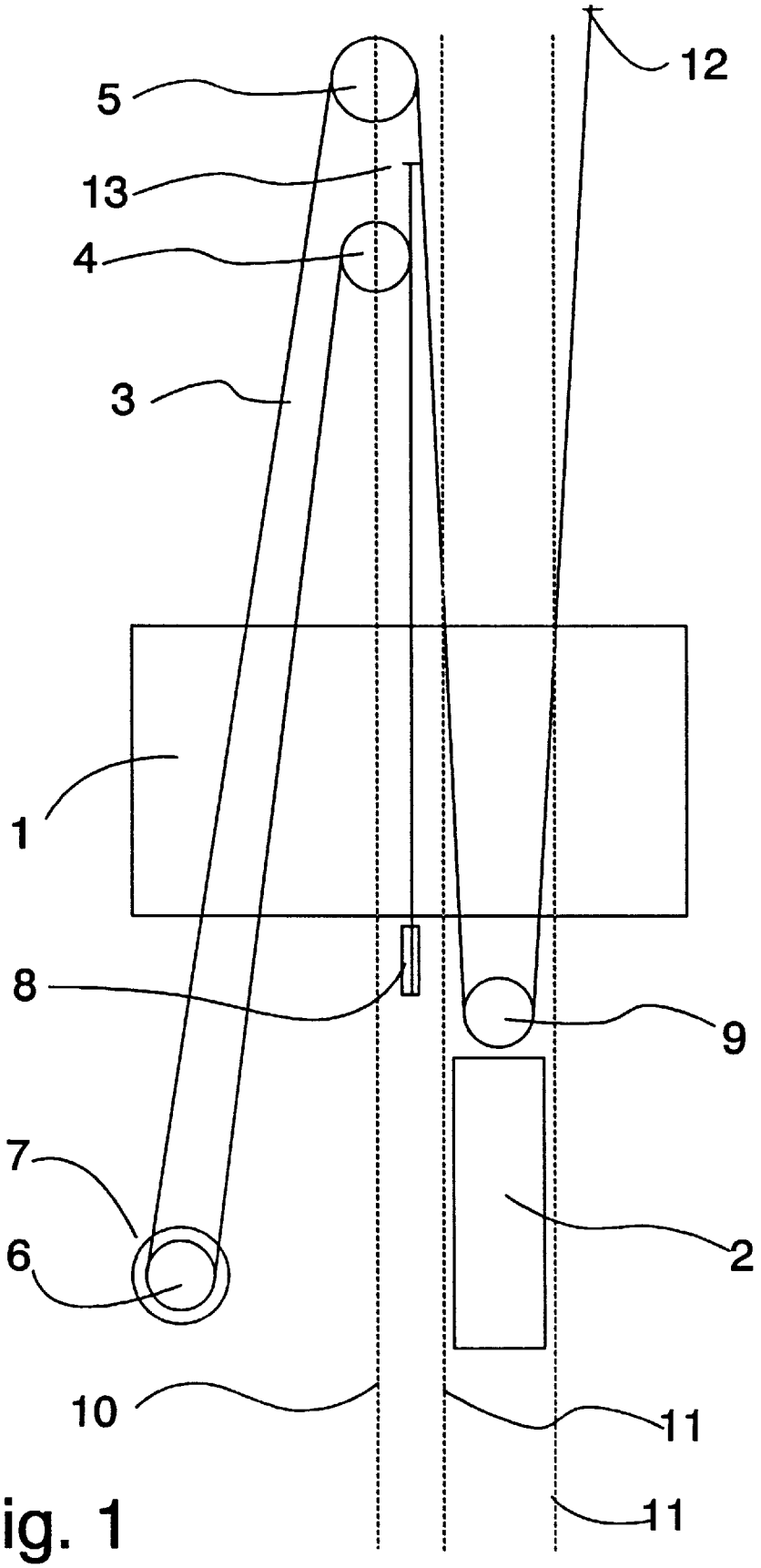
FIG. 1 presents a diagram representing a traction sheave elevator according to the invention.

FIG. 1 is a diagrammatic representation of a traction sheave elevator as provided by the invention. The elevator is a traction sheave elevator with machinery below. The elevator car 1 and counterweight 2 are suspended on the hoisting ropes 3 of the elevator. The suspension of the elevator car 1 from the hoisting ropes 3 is preferably essentially centric or symmetric relative to the vertical line passing through the center of gravity of the elevator car 1. Similarly, the suspension of the counterweight 2 from the hoisting ropes 3 is preferably essentially centric or symmetric relative to the vertical line passing through the center of gravity of the counterweight 2. The drive machine unit 6 of the elevator is placed in the elevator shaft, preferably in the lower part of the elevator shaft, and the hoisting ropes 3 are passed to the car 1 and counterweight 2 via diverting pulleys 4,5 placed in the upper part of the elevator shaft. In most cases, the hoisting ropes consist of a number of collateral ropes, usually at least three.

The elevator car 1 and counterweight 2 travel in the elevator shaft along elevator and counterweight guide rails 10,11 guiding them.

In FIG. 1, the hoisting ropes run as follows: One end of the ropes is fixed to an anchorage 12 at the top part of the shaft, from where the ropes go downward to the counterweight 2. The counterweight is suspended on the ropes 3 using a diverting pulley 9. From the counterweight, the ropes go up again to a first diverting pulley 5, which is mounted on an elevator guide rail 10, and from the diverting pulley 5 further to the traction sheave 7 driven by the drive machinery 6. From the traction sheave, the ropes go upward to a second diverting pulley 4 and round this pulley back down to the diverting pulleys 8 of the elevator car, passing below the car, and then further up to an anchorage 13 at the top part of the shaft, where the other end of the ropes is fixed. The elevator car 1 is suspended on the hoisting ropes 3 by means of diverting pulleys 8. In the hoisting ropes 3, one or more of the rope portions between the diverting pulleys or between the diverting pulleys and the traction sheave 7 or between the diverting pulleys and the rope anchorages 12,13 can run in a direction differing from the exact vertical direction, making it easy to provide a sufficient distance between different rope portions or between the hoisting ropes and the other elevator components. For rope passage, it is often advantageous to use diverting pulleys 4,5 of which the upper one has a larger diameter than the lower one. The traction sheave 7 and the hoisting machinery 6 itself lie aside from the paths of both the elevator car 1 and the counterweight 2, so they can easily be placed at almost any height in the elevator shaft below the diverting pulleys 4,5. As the machinery is not placed directly above or below the counterweight or elevator car, a saving can be achieved in the height of the elevator shaft. Therefore, the minimum height of the elevator shaft is only determined by the lengths of the paths of the elevator car and counterweight and the safety distances required above and below them.

Figure 2:
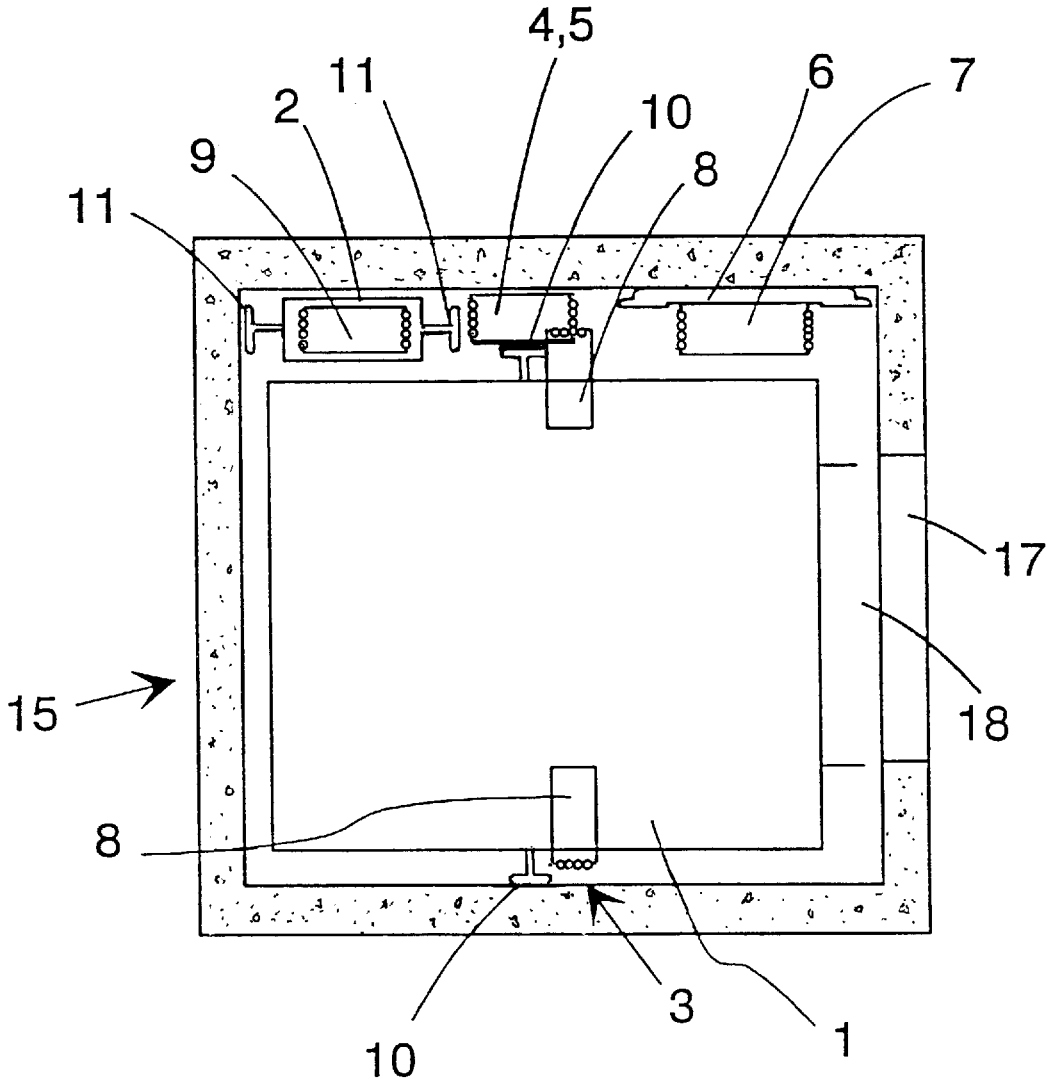
FIG. 2 presents an elevator as in FIG. 1 in the cross-section of the elevator shaft.

FIG. 2 illustrates the placement of the main elevator components in the cross-section of the elevator shaft 15. In the cross-sectional projection, the machinery 6 together with the traction sheave 7 is completely separated from the car 1 and counterweight. The machinery with the traction sheave and the counterweight 2 are placed on the same side of the elevator car 1 between the projection of the elevator car and the shaft wall. Relative to the counterweight 2, the machinery is located on the opposite side of the plane of the car guide rails 10 in the shaft 15 and it is fixed to the shaft wall or floor. Mounting the machinery on a wall or on the floor provides an advantage, because if the machinery were mounted on the same guide rail as the diverting pulleys 4,5, the guide rail would have to be of a stronger design. Individual hoisting ropes 3 are represented by the cross-sections of the rope portions going from the diverting pulleys and traction sheave in the up and down directions. The car is provided with a car door 18 and the wall of the elevator shaft 15 with a landing door 17 to provide access from the landing to the elevator car 1. Being flat in the direction of the axis of rotation of the traction sheave 7, the machinery 6 provides a space saving in the cross-sectional lay-out of the elevator shaft, because the gap between the car 1 and the wall of the shaft 15 required by such a machinery is not larger than the space needed for the counterweight. If the diverting pulley 5 supporting the counterweight is mounted on a counterweight guide rail 11, then it is easy to place the counterweight 2 and machinery 6 on opposite sides of the elevator car 1 in the cross-sectional lay-out of the elevator shaft 15. A lay-out like this may be needed e.g. when several elevators are mounted in shafts placed side by side and/or back to back. When both the diverting pulleys 4,5 and the rope anchorages 12,13 are supported by the guide rails, it is substantially not necessary to provide any other support to carry the weight of the counterweight and elevator car, so in this respect the attachments to the shaft wall can be relatively light and no special requirements relating to supporting the weight of the elevator car and counterweight need to be imposed on the construction of the shaft.

Figure 3:
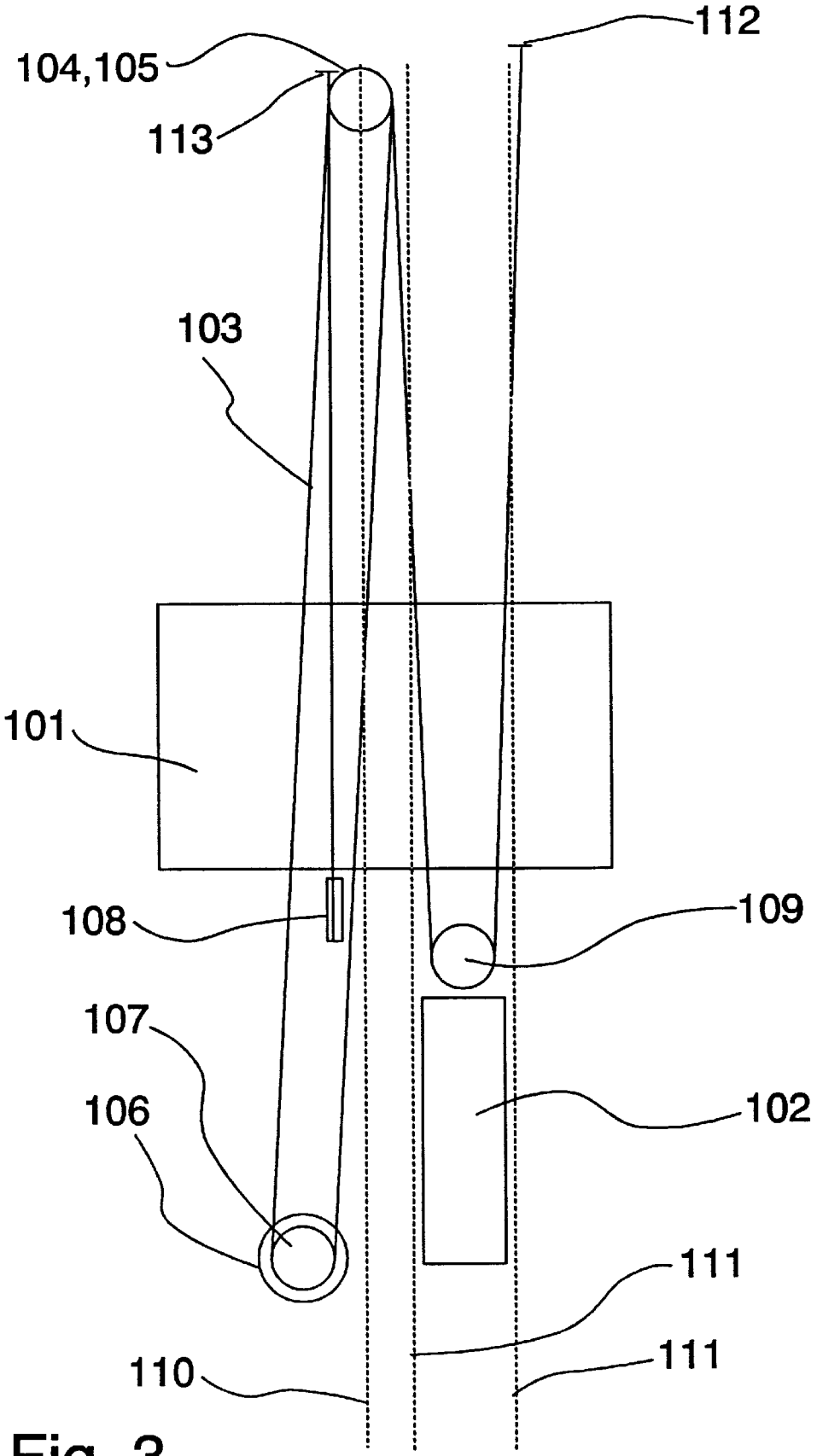
FIG. 3 presents a diagram representing another traction sheave elevator according to the invention.

Another traction sheave elevator according to the invention is presented in the form of a diagram in FIG. 3. This is a traction sheave elevator with machinery below. The elevator car 101 and counterweight 102 are suspended on the hoisting ropes 103 of the elevator. The drive machine unit 106 of the elevator is placed in the elevator shaft, preferably in the lower part of the shaft, and the hoisting ropes 103 are passed via diverting pulleys 104,105 to the car 101 and counterweight 102. The diverting pulleys 104,105 are placed side by side and preferably separately mounted with bearings on the same axle so that they can rotate independently of each other. The hoisting ropes 3 consist of at least three parallel ropes.

The elevator car 101 and the counterweight 102 travel in the elevator shaft along car and counterweight guide rails 110,111.

In FIG. 3, the passage of the hoisting ropes 103 is as follows: One end of the ropes is fixed to an anchorage 112 in the top part of the shaft, from where the ropes go downward to the counterweight 102. The counterweight is suspended on the ropes 103 using a diverting pulley 109. From the counterweight, the ropes go up again to a first diverting pulley 105, which is mounted on an elevator guide rail 110, and from the diverting pulley 105 further to the traction sheave 107 driven by the drive machinery 106. From the traction sheave, the ropes go upward to a second diverting pulley 104 and round this pulley back down to the diverting pulleys 108 of the elevator car, passing below the car, and then further up to an anchorage 113 at the top part of the shaft, where the other end of the ropes is fixed. The elevator car 101 is suspended on the hoisting ropes 103 by means of diverting pulleys 108. In the hoisting ropes 103, one or more of the rope portions between the diverting pulleys or between the diverting pulleys and the traction sheave 107 or between the diverting pulleys and the rope anchorages 112,113 can run in a direction differing from the exact vertical direction, making it easy to provide a sufficient distance between different rope portions or between the hoisting ropes and the other elevator components. The traction sheave 107 and the hoisting machinery 106 itself lie aside from the paths of both the elevator car 101 and the counterweight 102, so they can easily be placed at almost any height in the elevator shaft below the diverting pulleys 104,105. As the machinery is not placed directly above or below the counterweight or elevator car, a saving can be achieved in the height of the elevator shaft.

In the case of the elevators represented by FIGS. 1 and 3, a preferred embodiment is one in which that portion of the weight of the elevator car and counterweight which is supported by the diverting pulleys 4,5,104,105 is passed down via an elevator guide rail. In the elevator in FIG. 1, the rope portions going from the traction sheave 7 to the counterweight and to the elevator car meet the diverting pulleys 4,5 from the same side (from the left in FIG. 1) of the plane between the elevator guide rails, so the weight of elevator car and counterweight is naturally applied to the diverting pulleys 8 from the opposite side of the plane between the elevator guide rails. In the elevator in FIG. 3, the rope portions going from the traction sheave 107 to the counterweight and to the elevator car meet the diverting pulleys 104,105 from opposite sides (from the left in FIG. 1) of the plane between the elevator guide rails. In this case, the suspension of the elevator car and counterweight on the diverting pulleys 8 is a mirror image relative to the plane between the elevator guide rails as compared to the situation in FIG. 1. In this way, by slightly altering the rope passage, the rope suspension of the elevator car can be centered at a point where an advantageous support effect on the car is achieved.

Figure 4:
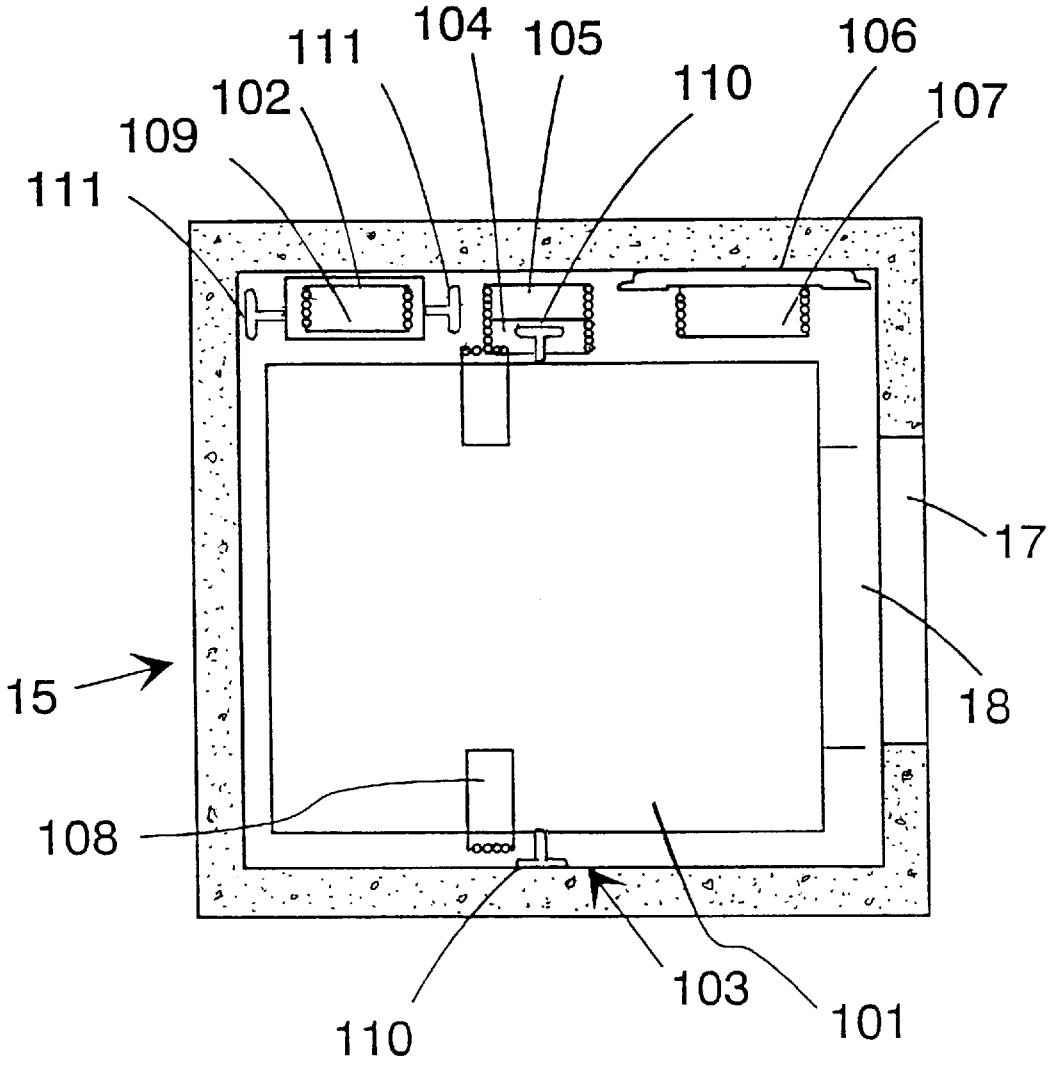
FIG. 4 presents an elevator as in FIG. 1 in the cross-section of the elevator shaft.

FIG. 4 illustrates the placement of the main components of an elevator as presented by FIG. 3 in the cross-section of the elevator shaft 15. In the cross-sectional projection, the machinery 106 with the traction sheave 107 is a completely separate unit. Individual hoisting ropes 103 are represented by the cross-sections of the rope portions going in the up and down directions from the diverting pulleys and traction sheave. The car is provided with a car door 18 and the wall of the elevator shaft 15 with a landing door 17 to provide access from the landing to the elevator car 101. Being flat in the direction of the axis of rotation of the traction sheave 107, the machinery 106 provides a space saving in the cross-sectional lay-out of the elevator shaft, because the gap between the car 101 and the wall of the shaft 15 required by such a machinery is not larger than the space needed for the counterweight. As for rope passage, it may be preferable to use diverting pulleys 104,105 of which one is larger than the other.

It is obvious to a person skilled in the art that different embodiments of the invention are not restricted to the examples described above, but that they may instead be varied in the scope of the claims presented below. For example, diverting pulleys placed side by side or one over the other can be used in either one of the example elevators to suspend the hoisting ropes appropriately in the elevator shaft. Similarly, the ropes can be passed obliquely below the elevator car so that both the plane between the guide rails and the plane of the loop formed by the ropes pass through the center of gravity of the car.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

We claim:

1. A traction sheave elevator in an elevator shaft, the elevator shaft having guide rails and the traction sheave elevator comprising:

drive machinery with a traction sheave, the drive machinery and the traction sheave being in the elevator shaft;

an elevator car and a counterweight mounted on the guide rails;

hoisting ropes extending from the traction sheave;

at least two diverting pulleys mounted on one of the guide rails, a first one of the diverting pulleys carrying a hoisting rope portion going from the traction sheave to the elevator car and a second one of the diverting pulleys carrying a hoisting rope portion going from the traction sheave to the counterweight.

2. The traction sheave elevator as defined in claim 1, wherein the diverting pulleys are mounted on an upper part of the one guide rail and wherein the hoisting ropes extend upwardly from the traction sheave.

3. The traction sheave elevator as defined in claim 1, wherein the hoisting ropes are arranged so that the first diverting pulley rotates in a reverse direction relative to a direction of rotation of the second diverting pulley.

4. The traction sheave elevator as defined in claim 1, wherein the hoisting ropes are arranged so that the first diverting pulley rotates in a same direction as that of the second diverting pulley.

5. The traction sheave elevator as defined in claim 4, wherein the first diverting pulley has a diameter differing from that of the second diverting pulley.

6. The traction sheave elevator as defined in claim 4, wherein the first diverting pulley and the second diverting pulley are mounted side-by-side on an upper part of the guide rail.

7. The tractor sheave elevator as defined in claim 4, wherein the first diverting pulley and the second diverting pulley are mounted one over the other on an upper part of the guide rail.

8. The traction sheave elevator as defined in claim 1, wherein the first diverting pulley has a diameter differing from that of the second diverting pulley.

9. The traction sheave elevator as defined in claim 3, wherein the first diverting pulley has a diameter differing from that of the second diverting pulley.

10. The traction sheave elevator as defined in claim 1, wherein the first diverting pulley and the second diverting pulley are mounted side-by-side on an upper part of the guide rail.

11. The traction sheave elevator as defined in claim 3, wherein the first diverting pulley and the second diverting pulley are mounted side-by-side on an upper part of the guide rail.

12. The traction sheave elevator as defined in claim 1, wherein the first diverting pulley and the second diverting pulley are mounted one over the other on an upper part of the guide rail.

13. The traction sheave elevator as defined in claim 3, wherein the first diverting pulley and the second diverting pulley are mounted one over the other on an upper part of the guide rail.

* * * * *